United States Patent [19]

Kamp

[11] Patent Number: 4,562,560

[45] Date of Patent: Dec. 31, 1985

[54] METHOD AND MEANS FOR TRANSMITTING DATA THROUGH A DRILL STRING IN A BOREHOLE

[75] Inventor: Anthony W. Kamp, Rijswijk, Netherlands

[73] Assignee: Shell Oil Company, Houston, Tex.

[21] Appl. No.: 425,150

[22] Filed: Sep. 28, 1982

[30] Foreign Application Priority Data

Nov. 19, 1981 [GB] United Kingdom ..... 8134886

[51] Int. Cl.[4] ..... G01V 1/40

[52] U.S. Cl. ..... 367/83; 367/911; 175/40

[58] Field of Search ..... 367/81–83, 367/912, 84–85, 911; 175/40, 48, 50, 107; 73/151; 33/307; 340/854, 853, 861; 310/102 R

[56] References Cited

U.S. PATENT DOCUMENTS

| | | | |
|---|---|---|---|
| Re. 30,246 | 4/1980 | Richter, Jr. et al. | 367/83 |
| 2,250,912 | 7/1941 | Hudson et al. | 255/4 |
| 3,112,801 | 12/1963 | Clark et al. | 175/107 |
| 3,693,428 | 9/1972 | LePeuvedic et al. | 73/151 |
| 4,078,620 | 3/1978 | Westlake et al. | 175/48 |
| 4,351,037 | 9/1982 | Scherbatskoy | 367/85 |
| 4,462,469 | 7/1984 | Brown | 175/107 |

OTHER PUBLICATIONS

1984–85 Composite Catalog of Oil Field Equipment & Services, "Directional Drilling Equipment", Posi--Drill, published by World Oil, pp. 11–12.

*Primary Examiner*—Nelson Moskowitz
*Assistant Examiner*—Ian J. Lobo

[57] ABSTRACT

Data are transmitted through a column of drilling mud in a drill string that is being used in drilling a borehole in an underground formation. The data are in the form of pressure waves (such as pressure pulses) and are generated by means of a downhole mud motor that is driven by the drilling mud. The pressure waves are generated by varying the load on the mud motor according to a predetermined pattern that is representative of the data to be transmitted.

5 Claims, 3 Drawing Figures

METHOD AND MEANS FOR TRANSMITTING DATA THROUGH A DRILL STRING IN A BOREHOLE

BACKGROUND OF THE INVENTION

The invention relates to a method and means for transmitting data through a drill string in a borehole.

While drilling boreholes in underground formations, information on a number of downhole parameters, such as azimuth, inclination, tool face, weight on bit, borehole temperature, pressure, and downhole motor speed, should be available to the drilling crew to guide them in making the correct decisions during progress of the drilling operation.

To this end, sensors are placed near the drill bit, which sensors are suitable for obtaining data on specific parameters. The data are subsequently encoded in a form suitable for transmission thereof to the surface, where they are decoded and transformed to a form suitable for interpretation by the drilling crew.

The present invention relates in particular to a method and means for transmitting data to the surface in the form of pressure variations through the drilling liquid or mud in the drill string. Such pressure variations (also indicated as acoustic waves) may be in the form of pressure pulses, and are generated in the column of drilling mud present in the drill string by varying the resistance that the flow of drilling mud meets in the lower parts of the drill string. In the systems applying acoustic waves for data transfer, the measured values of a particular parameter are encoded in a pattern of electric signals that control the position of a valve in the drill string in such a manner that the valve is successively opened and closed stepwise according to the pattern, thereby raising pressure variations in accordance with this pattern in the column of drilling mud. The pressure variations travels upwards through the drilling mud to the surface, where they are detected by a pressure sensor lcoated in the supply conduit of the drilling mud to the drill string. The pattern of pressure variations that represents a particular value of the measured parameter is then decoded and the value of the parameter is presented to the drilling crew in a form suitable for a ready understanding, and/or stored in a suitable form for later study.

The presently most common way of opening and closing the valve for generating the pressure variations, is by actuating the valve by means of a solenoid. The valves, however, rapidly wear away by the erosive action of the drilling mud that passes the valves in turbulent flow. Moreover, the actuation of the valves consumes a considerable amount of electric energy, which energy should be made available from batteries located in the drill string and/or be generated in-situ by electric generators driven by liquid turbines that are located in the mud flow passing through the drill string. The use of large-sized batteries is not attractive since they are rather costly and require a large space in the drill string. The use of hydraulically actuated turbines is not attractive in view of the high costs of the turbines and their liability to plugging and wear by the drilling mud.

SUMMARY OF THE INVENTION

The object of the invention is to avoid the above drawbacks. Thereto, the invention provides a method and means for transmitting data through a drill string to the surface, wherein the data are in the form of pressure variations that are generated by equipment that is less liable to wear than valves, and that may be operated at extremely low consumption of electric energy.

The method according to the invention includes the steps of flowing drilling mud through the drill string and through a downhole mud motor of the positive displacement type, and varying the load on the motor according to a predetermined pattern.

The load on the motor may be varied by varying the electric load of a rotary electric generator that is driven by a motor.

According to another aspect of the invention, the means for transmitting data through a drill string includes a tubular element adapted for being coupled to the drill string and enclosing a mud motor of the positive displacement type, a brake arranged to brake the outlet shaft of the motor, and control means to control the action of the brake.

BRIEF DESCRIPTION OF THE DRAWINGS

The invention will be described hereinafter by way of example in greater detail with reference to the drawings, wherein.

DESCRIPTION OF PREFERRED EMBODIMENT

Figure 1:
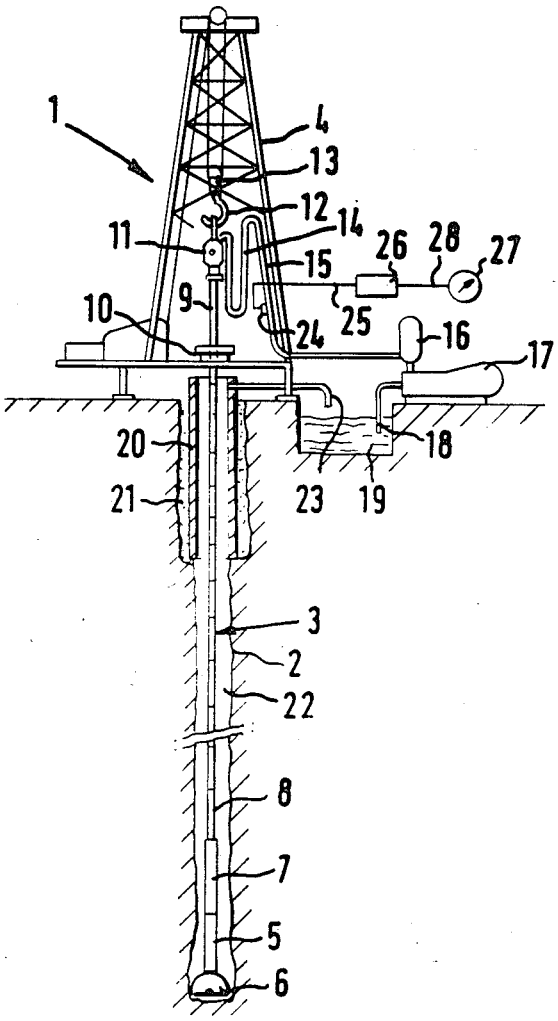
FIG. 1 shows schematically a longitudinal section over a well that is being drilled by means of rotary drilling equipment including means according to the present invention.

FIG. 1 shows schematically a conventional drilling rig 1 located at a site above the borehole 2. The drill string 3 is supported from the derrick 4 and includes a tubular element 5 (that will be described hereinafter in more detail with reference to FIGS. 2 and 3 of the drawings). The drill string further includes a drilling bit 6, one or more drill collars 7, a plurality of drill pipes 8 and a kelly 9 that cooperates with a rotary table 10. The drill string 3 is supported via a swivel 11 by the hook 12 of a block and tackle arrangement 13.

The interior of the drill string communicates via the swivel 11, a mud hose 14, and a stand pipe 15 with the pressure accumulator 16 of a mud pump 17. The inlet 18 of the mud pump communicates with a mud pit 19.

A casing 20 has been set by cement 21 in the upper part of the borehole 2. The lower part of the hole is uncased. Drilling mud that is sucked from the mud pit 19 by the mud pump 17, is subsequently supplied under pressure to the swivel 11 via the accumulator 16, the stand pipe 15, and the mud hose 14. The mud passes from the swivel 11 through the interior of the drill string 3 to the bottom part of the hole 2, and subsequently flows upwards via the annulus 22 around the string 3 to the upper part of the casing 20, from where it is returned via conduit 23 to the mud pit.

The pressure of the mud that passes through the stand pipe 15 is measured by the pressure sensor 24 which has the sensitive part thereof mounted in the stand pipe 15. The measured value is transmitted via the electric cable 25 to a signal processor 26 adapted for detecting variations in the measured value, identifying particular patterns of these variations, and decoding such patterns into a form that can be displayed on the display 27 that is connected to the signal processor 26 by an electric cable 28.

As will be explained hereinafter, the particular patterns of variations in the measured value that are identified by the signal processor originate from pressure variations that have been generated in the tubular element 5 that is located just above the drilling bit 6 of the drill string 3. These pressure variations are generated in a pattern that is representative of a value of a parameter measured down the hole, such as the pressure of the drilling mud at a location close to the drilling bit 6. The pressure pulses travel through the drilling mud in the drill string 3, to the surface where they are detected by the sensor 24.

The signal processor 26 is adapted to detect and to identify the signals representing the pressure waves (such as pressure pulses) that have been generated in the tubular element 5, out of the assembly of signals that represents all pressure variations detected by the sensor 24, which assembly includes the signals originating from the pressure variations in the drilling mud that have been generated by the action of the mud pump 17.

Figure 2:
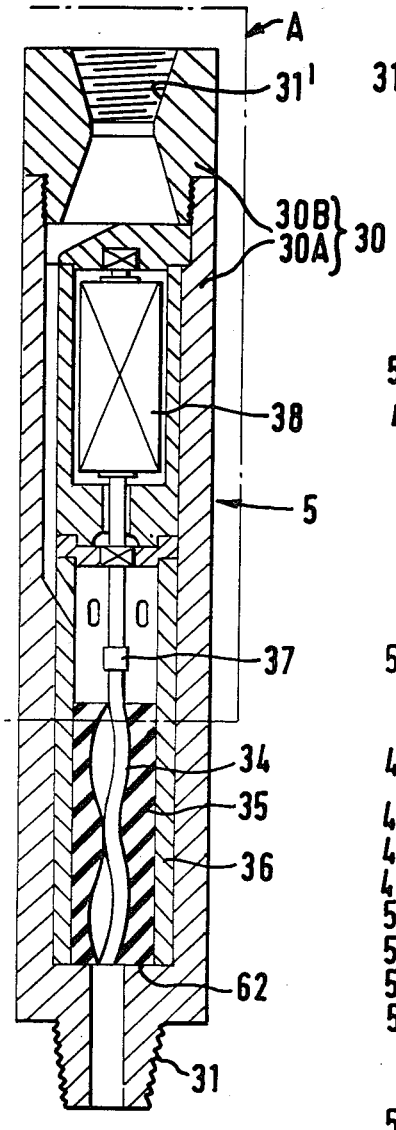
FIG. 2 shows schematically (on a larger scale than the scale of FIG. 1) a longitudinal section over the tubular element 5 of FIG. 1.
Figure 3:
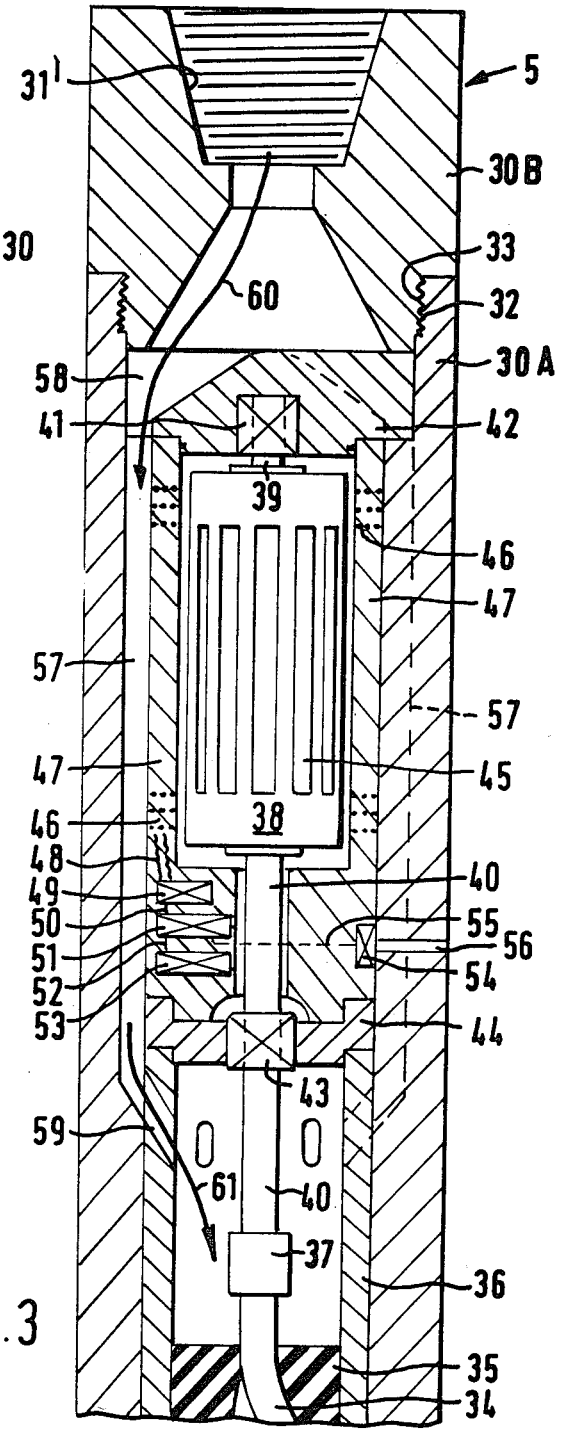
FIG. 3 shows schematically the area A of FIG. 2 on a larger scale than the scale of FIG. 2.

Reference is now made to FIG. 2 of the drawing, which schematically shows a longitudinal section over the tubular element 5. Reference is further made to FIG. 3, which shows area A of FIG. 2 on a scale larger than the scale of FIG. 2. The tubular element 5 comprises a housing 30 consisting of two parts 30A and 30B. The lower part 30A is provided with a pin-shaped conical screw thread 31 for connecting the housing 30 directly or indirectly to the drilling bit 6 (shown in FIG. 1), and with a cylindrical screw thread 32 (see FIG. 3) cooperating with the screw thread 33 of the upper part 30B. The upper end of part 30B is provided with a conical box-thread 31' for coupling the housing to the lower end of the drill collar 7 (shown in FIG. 1).

The interior of the lower part of the housing 30 houses a mud motor of the positive displacement type. The motor is a Moineau (or Mono-) motor. This type of motor is widely known, and described among others in U.S. Pat. No. 2,250,912 (inventors T. B. Hudson and W. S. Gerber; filed Oct. 9, 1939; issued July 29, 1941) and U.S. Pat. No. 3,112,801 (inventors W. Clark and A. S. Goldstein; filed Mar. 5, 1959; issued Dec. 3, 1963). The motor comprises a rotor 34 made of stainless steel or other suitable material, and a stator 35 made of rubber or other resilient material. The stator is molded to the inner wall of a tube 36.

The upper end of the stator 34 is coupled by means of a flexible coupling 37 to the rotor 38 of a rotary electric generator. The rotor 38 is carried by the rotary shafts 39 and 40. The upper shaft 39 is supported (in a vertical as well as in a lateral sense) by the bearing 41, which bearing is carried by the element 42. The lower shaft 40 is supported (in a lateral sense) by the bearing 43, which bearing is carried by the ring member 44. The lower shaft 40 is connected to the rotor 34 of the mud motor by means of the flexible coupling 37 to allow a smooth rotation of the rotor 34 of the Moineau motor in the interior of the stator 35.

The rotor 38 of the electric generator carries magnetic elements 45 that face the stator coils 46 of the electric generator. The stator coils 46 are embedded in a ring-shaped member 47 made of a suitable electric isolating material. The coils 46 are arranged in a manner so as to be under influence of a magnetic field varying in magnitude when the magnetic elements 45 of the rotor 38 are rotated about the axis of rotation of the shafts 39 and 40.

The coils 46 are made of material having a relatively low electric resistance. The terminals 48 of the coils are connected to an electric switch 49. By closing the switch, the terminals of the coils are short-circuited, as a result whereof electric current will pass through the windings of the coils 46 when the rotor 38 is rotated with respect to the stator coils 46.

The switch 49 is provided with an actuator (not shown), which latter is electrically connected by leads 50 to a signal processor 51 that is supplied with electric energy via leads 52 from a small-sized accumulator 53. Signals for activating the processor originate from the pressure sensor 54 that is electrically connected to the processor by the leads 55. The sensor 54 communicates hydraulically with the exterior of the housing 30A (which is submerged in drilling mud during drilling of the hole) via an opening 56 in the wall of the housing 30A.

The switch 49, signal processor 51, accumulator 53 and the sensor 54 are embedded in the electric isolating material of the ring member 47, which material also encloses the electric stator coils 46 of the electric generator.

The housing 30B is provided with grooves 57 in the inner wall thereof, which grooves form a communication between channels 58 in the element 42 and the openings 59 in the tube 36 of the mud motor. Thus, mud can flow downwards through the housings 30B and 30A in the direction of arrows 60 and 61. The mud first cools the element 47 enclosing the electric coils 46, and then enters the mud motor into the cavity existing between the rotor 34 and the stator 34 thereof. The spacing housing the rotor 38 of the electric generator may be filled with a suitable fluid. If desired, pressure compensation means (not shown) may be provided that maintain a pressure inside the space that is equal to the pressure of the drilling mud. Where required, suitable sealing means have been mounted to prevent undesirable leakage of fluids past the various elements and ring members.

In assembling the tubular element 5, the ring members 36, 44 and 47 and the element 42 are mounted on each other and the pile thus formed is lowered into the lower housing part 30A until the lower rim of the member 36 rests on the shoulder 62 of the lower housing part 30A. Thereafter, the upper housing part 30B is screwed onto the top of the lower housing part 30A. Means (not shown) are provided to lock the ring members and the element 42 against rotation in the housing 30.

The method of transmitting data through the drill string 3 by means of the apparatus as described above with reference to FIGS. 1–3 of the drawings will now be explained.

During the drilling process, drilling mud is circulated by the pump 17 through the pressure accumulator 16, the stand pipe 15 (thereby passing along the pressure sensor 24), the mud hose 14, the swivel 11, the drill string 3 (of which the kelly 9, the drill pipes 8, the drill collar 7, the tubular member 5, and the drilling bit 6 form part), the annulus 22, the casing 20, the conduit 23, the mud pit 19 and the suction conduit 18.

Inside the tubular member 5, the drilling mud flows in the direction of the arrows 60 and 61 (see FIG. 3), thereby passing through the grooves 57 of the housing 30A, and through the cavity in the stator 35 of the mud motor. The mud activates the rotor 34 of the motor, thereby rotating the shaft 40 of the rotor of the electric generator. By the rotation of the rotor 38, the magnetic elements 45 pass along the stator coils 46, but as long as the switch 49 is open, the electric load on the generator is zero, and the rotor 34 of the mud motor is only loaded by the friction exerted on the rotors 34 and 38, and the friction raised in the bearings 41 and 43. Thus, the pressure difference across the mud motor is extremely small. Moreover, this pressure difference is constant, and the pressure variations measured by the pressure sensor 24 in the stand pipe 15 all originate from the action of the pump, as well as from vibrations that might be raised in the various conduits by the flow of the drilling liquid therethrough.

During the drilling operation, the pressure in the drilling mud outside the tubular element 5 (see FIG. 3) is sensed by the sensor 54 and an electric signal representative of the measured value of this pressure is transmitted via the leads 55 to the signal processor 51 which has been programmed to encode the measured value in a predetermined pattern of electric pulses which pattern is representative of the measured value. The sequence of electric pulses is passed on via the leads 50 to the switch 49, which switch is closed each time that an electric pulse is received by the actuator of the switch.

On closing of the switch 49, the terminals 48 of the coils 46 are short-circuited, and an electric current is generated in the coils 46 by the action of the magnets 45. This variation in the electric load of the generator is a variation in the load of the mud motor, which—since the motor is of the positive displacement type—results in a sudden increase of the pressure at the entry side of the mud motor. This pressure increase is detected at the surface by the pressure sensor 24 in the stand pipe 15, and the measured value thereof is transmitted via the electric cable 25 to the signal processor 26.

The succession of electric pulses that are passed by the signal processor 51 to the actuator of the switch 49 is, as has been mentioned hereinabove, in a particular pattern that represents a measured value of the pressure outside the tubular element 5. By the action of the electric generator and the mud motor, the particular pattern of successive electric pulses is translated into a series of pressure variations of the same pattern. These pressure variations are generated in the drilling mud present in the interior of the tubular element 5, and travel upwards through the drill string 3, the swivel 11, to the mud hose 14 and the stand pipe 15. This pattern of pressure pulses is detected by the pressure sensor 24 in the stand pipe 15, and transduced into a pattern of electric signals that is passed to the processor 26 via the electric cable 25.

The processor 26 is programmed to filter this patter of electric signals from the electric signals that originate from the pressure variations detected by the sensor 24 and originating from the action of the pump 17 and the vibration of conduits or pipes in the drilling liquid circulation system. The pattern of electric signals is then decoded and transformed into a form that is displayed on the display 27. If desired, the values displayed may be stored in a suitable form (such as on tape) for further study.

It will be appreciated that the application of the method and means of the present invention is not restricted to the transmission of data of only a single parameter. More than one sensor for measuring downhole parameters (such as temperature, weight on bit, and formation properties) may be installed in the tubular element 5, or at or near the lower end of the drill string 3. The signal processor is then programmed to translate the measured values of the various parameters into patterns of electric pulses, each pattern of which can easily be identified as relating to a particular parameter. Processor program suitable for this purpose can easily be made by the experts and therefore do not require any further detailed explanation.

If desired, a suitable variable electric resistance may be installed between the switch 49 and the terminals 48 of the electric generator. The amplitude of the load variations on the mud motor and consequently also in the amplitude of the pressure variations that represent the desired pattern of pressure signals that are to be passed to the surface is then adjustable in value.

Downhole motors of the positive displacement type other than the Moineau motor decribed with reference to the drawings, may also be applied in the apparatus and method according to the invention. Vane motors are also suitable for the purpose. It is observed that hydraulic turbines are not suitable, since the pressure drop of the liquid passing through such turbines is not related to the load exerted on the turbine outlet shaft.

If desired, the terminals of the electric generator driven by the mud motor may be connected to the electric accumulator 53 to continuously recharge the battery. This is in particular desirable when downhole sensors are present that consume larger amounts of energy, such as logging equipment measuring the electric resistance of the formation that is being penetrated by the drilling bit.

Also, the drilling bit may be driven by the mud motor of the positive displacement type. The variations in the electric load on the electric generator, which variations represent a particular value of a parameter, then raise pressure variations in the flow of drilling mud that are passed on through the drill string to the mud motor. These pressure variations are superimposed on the supply pressure of the liquid flow to the mud motor, and are detected by the pressure sensor present in the conduits on the surface that lead the drilling mud from the mud pump to the swivel.

It will be appreciated that application of the invention is not limited to the use of the particular type of electric generator that has been shown in the drawings. Any other type of electric generator that is suitable for varying the load on the mud motor, and that has been designed for operation in the rather hostile environment of a hole that is being drilled, may be used as well.

Furthermore, the electric generator that functions as a brake means for braking the mud motor, may be replaced by any other type of brake that is suitable for the purpose. Therefore, in another embodiment of the invention, the brake means may consist of a mechanical brake which includes a conical member driven by the shaft of the mud motor, and cooperating with a body having a conical cavity that matches the conical member. By displacing the body longitudinally with respect to the conical member, the body and the member act as braking means. The relative displacement between the member and the body can be obtained in various ways, such as by a solenoid. The braking force of the mechanical brake is thereby varied from zero to a predetermined value.

What is claimed is:

1. A method of transmitting data through a drill string in a borehole extending from the surface of the earth to an underground formation, wherein drilling mud is passed through the drill string, which drilling mud actuates a downhole mud motor of the positive displacement type carried by the drill string, which method includes the sequential steps of:

measuring values of at least one parameter down the hole;

encoding the measured values in patterns of electric signals;

varying the load on the downhole mud motor by means of the electric signals, thereby generating successive pressure pulses in the flow of drilling mud in patterns representative of the patterns of the electric signals; and detecting the patterns of pressure pulses at the surface and generating signals representative of the measured values in a readable or storable form.

2. The method according to claim 1, wherein the load of the downhole mud motor is varied by alternately decreasing and increasing the electric load of an electric generator driven by the downhole mud motor.

3. A system for transmitting data through a drill string in a borehole, the system comprising:

a source for pressurized drilling mud;

a drill string extending into said borehole;

a conduit, said conduit being connected to said source and said drill string;

a pressure sensor mounted on the conduit for detecting pressure variations of the drilling mud passing through the conduit;

a drill bit secured to the lower end of the drill string;

a tubular element carrying a mud motor of the positive displacement type, said tubular element being disposed in said drill string and in communication with the interior of the drill string;

a sensor for generating an electric signal of varying value related to the data to be transmitted;

a signal processor for encoding the electric signals in a pattern of electric pulses representative of the value of the electric signal;

a brake coupled to the motor; and means for stepwise varying the braking force, said latter means being controlled by the electric signal consisting of electric pulses.

4. The means of claim 3 wherein the brake consists of an electric generator, and the means for varying the load of the electric generator includes an electric switch that is included in an electric circuit connected to the terminals of the generator.

5. The means of claim 4, wherein the electric circuit includes an electric resistance.

* * * * *